United States Patent [19]

Huggins et al.

[11] 4,156,526

[45] May 29, 1979

[54] GOLF CLUB PUTTER

[76] Inventors: Clifford L. Huggins, 2767 W. First St., Santa Ana, Calif. 92703; Russell R. Huggins, 486 Newport Blvd., Newport Beach, Calif. 92663

[21] Appl. No.: 867,663

[22] Filed: Jan. 9, 1978

[51] Int. Cl.[2] ..... A63B 53/08

[52] U.S. Cl. ..... 273/78

[58] Field of Search ..... 273/77 R, 78, 167 R, 273/167 J, 173

[56] References Cited

U.S. PATENT DOCUMENTS

| | | | |
|---|---|---|---|
| 1,907,134 | 5/1933 | Weiskopf | 273/78 |

FOREIGN PATENT DOCUMENTS

| | | | |
|---|---|---|---|
| 5741 of | 1891 | United Kingdom | 273/78 |
| 11350 of | 1898 | United Kingdom | 273/78 |
| 23691 of | 1906 | United Kingdom | 273/78 |
| 2003 of | 1914 | United Kingdom | 273/78 |

*Primary Examiner*—Richard J. Apley
*Attorney, Agent, or Firm*—William C. Babcock

[57] ABSTRACT

A golf club putter that includes a head and shaft, with the head being defined by pairs of side walls and end walls and a back wall that cooperate to provide an elongate cavity of substantially greater length than width. A resilient block is disposed in the cavity and extends forwardly therefrom to terminate in a flat striking surface disposed forwardly of the leading edges of the pairs of side walls and end walls. The pair of side walls has a pair of rearwardly extending centrally disposed recesses formed therein. The striking surface when a portion thereof between the pair of recesses impacts a golf ball deforms rearwardly momentarily into a generally elliptical configuration that has the major axis thereof substantially normal to the surface on which the golf ball rests, and the deformed portion while still in contact with the golf ball returning towards its initial flat shape to impart forward motion to the golf ball. The deformed portion does not deflect the golf ball laterally as the major part of the deformation is vertical rather than horizontal. The pair of recesses in addition to serving this function prevents the leading edges of the pair of side walls contacting the golf ball during the putting of the latter. Also, the pair of recesses permits opposite sides of the resilient block to be gripped between the thumb and forefinger to facilitate the removal of the block from the cavity to permit another block of lesser or greater resiliency to be inserted in the cavity.

2 Claims, 6 Drawing Figures

FIG. 1
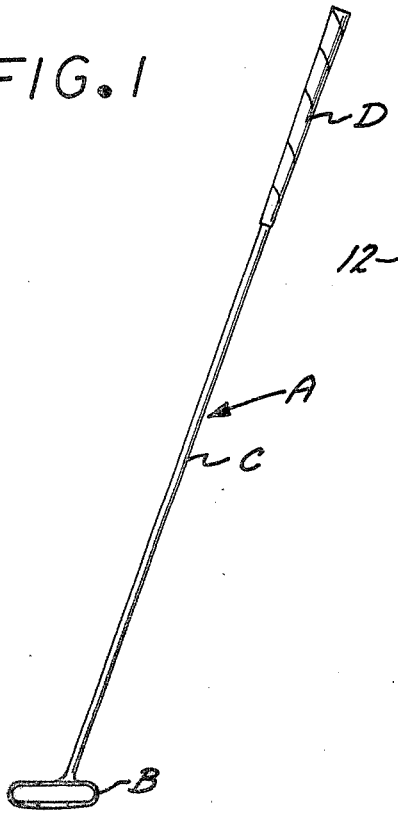
FIG. 2
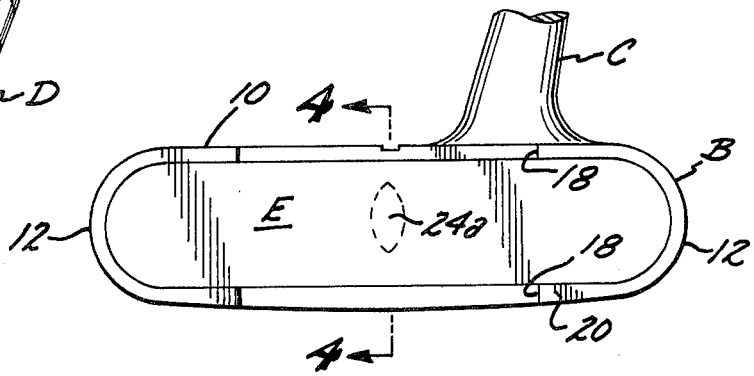
FIG. 3
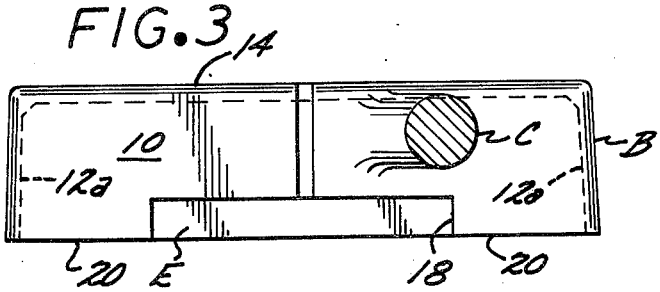
FIG. 4
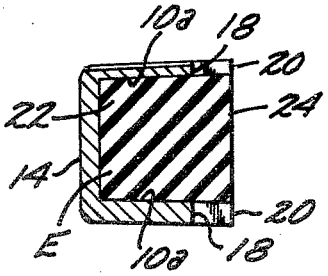
FIG. 6
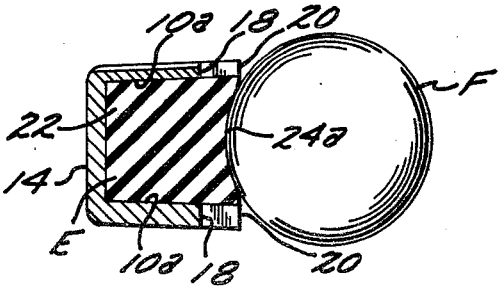
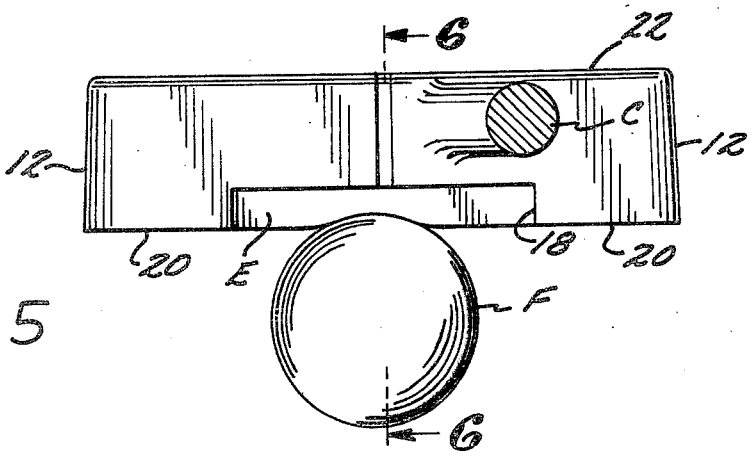
FIG. 5

GOLF CLUB PUTTER

BACKGROUND OF THE INVENTION

1. Field of the Invention

Gold club putter.

2. Description of the Prior Art

In the game of golf, the failure of a player to putt accurately is the major reason for failing to obtain a low score. Putting requires a high degree of muscular control on the part of a player that must be correlated with his vision and his sense of distance to the extent that the golf ball is directed in a path in alignment with the hole and at such velocity as to drop into the hole. The novice player as well as the experienced player find it extremely difficult to achieve the above results, when the motion to the golf ball is imparted by contact with a hard striking surface.

A major object of the present invention is to provide a gold club putter that has a rigid head in which an elongate cavity is defined that is of substantially greater length than width, and the cavity supporting a resilient block that extends forwardly therefrom to terminate in a flat striking surface, and the head of such structure that the leading edges thereof cannot contact a golf ball during the putting of the latter, and the head permitting easy interchange of the blocks of different resiliency.

Another object of the invention is to supply a resilient body supporting putter head, in which a portion of the resilient flat striking surface deforms rearwardly momentarily on contacting the ball, with the major portion of this deformation being in a vertical direction, and the deformed portion of the striking surface as it returns towards its initial form propelling the ball in a desired path normal to the striking surface due to the configuration of the deformed portion.

SUMMARY OF THE INVENTION

A golf club putter that includes a head that has a shaft extending upwardly therefrom. The head is defined by a pair of end walls, a pair of side walls substantially longer than the pair of end walls, and a back wall. The pairs of end walls, side walls and back wall cooperate to define an elongate cavity in which a resilient block is disposed that extends forwardly from the head to terminate in a flat striking surface. The block is preferably removably mounted in the cavity to permit it to be interchanged with a block having a different resiliency that is suited for a particular player.

The side walls have a pair of centrally disposed recesses formed therein, which recesses extend rearwardly from the leading edges of the side walls.

The pair of recesses provide three functions. The recesses prevent the leading edges of the pair of side walls inadvertently contacting a golf ball during the putting of the latter. Also, the pair of side walls expose opposite side surfaces of the block that may be gripped between the thumb and forefinger to remove the block from the cavity as well as facilitating the positioning another block of different resiliency in the cavity.

The pair of recesses cooperate with the block to define a portion of the latter in which it is easier to deform vertically rather than horizontally when a portion of the flat striking surface momentarily deforms rearwardly upon forceful contact with a golf ball in the putting of the latter. Due to the major portion of the deformation of the block being in a vertical rather than a horizontal direction, the deformed surface portion of the block has little or no tendency to laterally deflect the golf ball from moving in a path normal to the striking surface.

BRIEF DESCRIPTION OF THE DRAWINGS

FIG. 1 is a perspective view of the golf club putter;

FIG. 2 is a front elevational view of the putter head and the supported resilient block, and the area of momentary deformation of the striking surface being indicated in a phantom line that takes place when the resilient block contacts a golf ball;

FIG. 3 is a top plan view of the golf club head;

FIG. 4 is a transverse cross-sectional view of the golf club head taken on the line 4–4 of FIG. 2;

FIG. 5 is a top plan view of the golf club head in contact with a golf ball; and FIG. 6 is the same view as shown in FIG. 4 during contact with a golf ball.

DESCRIPTION OF THE PREFERRED EMBODIMENT

The golf club putter A as may be seen in the drawing includes a head B from which a shaft C extends upwardly, with the upper portion of the shaft C having a handle D mounted thereon.

The head B is defined by a pair of spaced side walls 10, a pair of end walls 12, and a back wall 14 that extends between the trailing edges of the pairs of side walls and end walls. The pairs of side walls 10 and end walls 12 have interior surfaces 10*a* and 12*a*that taper inwardly towards one another and terminate at the back wall 14. The pair of side walls 10 have a pair of centered recesses 18 therein that are laterally aligned, and extend rearwardly from the leading edges 20 of the side walls.

The back wall 14 and pairs of side walls 10 and end walls 12 cooperate to define an elongate cavity 22 that has a length substantially greater than the width thereof.

A number of blocks E are provided that are formed from a resilient material, with each block being of a different shore hardness. A block E of desired resiliency is press-fit into cavity 22 and is frictionally gripped therein by the tapered interior surfaces 10*a* and 12*a*. The block E is of such depth that a flat striking surface 24 thereof is flush with the leading edges 20.

When the golf club A is used in putting a golf ball F, the head B will swing through an arcuate path for the part of the striking surface 24 between the pair of recesses 18 to imparct on the golf ball. Due to the pair of recesses 18, the leading edges 20 will not inadvertently contact the ball.

Upon the striking surface 24 impacting the ball F a portion 24*a* thereof will momentarily deform rearwardly, which portion is shown in phantom line in FIG. 2. As such deformation takes place, vertically aligned portions of block E may momentarily expand rearwardly and upwardly and downwardly due to being situated within the confines of the pair of recesses 18. Due to the resiliency of the material defining the block B, the deformed portion 24*a* while in contact with golf ball F will tend to move forwardly to its initial configuration, and in so doing impart forward motion to the golf ball. Due to there being a less distance from the area of impact to the sides of the block E than to the ends thereof, and the fact that the forward portions of the side walls of the block E are situated between the pair of recesses 18 and are unrestrained against lateral outward deformation, the rearwardly deformed area 24*a* will be generally elliptical in in shape, with the major axis thereof substantially horizontal.

When the deformed portion 24*a* returns to its initial configuration, the movement in so doing is substantially vertical relative to the golf ball F and there is accordingly no tendency to divert the golf ball from following a path normal to the striking surface 24.

The pair of recesses permit opposite forward side surfaces of the block E to be gripped between the thumb and forefinger to permit a resilient block E to be removed from the cavity 22 and another block of a different degree of resiliency substituted therefor. However, if desired, a block E of proper resiliency for a particular player may be permanently bonded to the interior surfaces 10*a* and 12*a* to form an integral part of head B.

The use and operation of the invention has been described previously in detail and need not be repeated.

What is claimed is:

1. In a golf club putter of the type that includes a head and a shaft extending upwardly therefrom, said golf club putter being characterized by said head being of elongate shape and defined by vertically spaced upper and lower parallel side walls, a pair of connecting end walls and a back wall, said end walls and side walls including leading edges and trailing edges, said back wall extending between said trailing edges, said upper and lower side walls having vertically aligned elongate recesses that extend rearwardly from the leading edges thereof and said recesses of substantially less length than that of said head, said upper and lower side walls, pair of end walls and said back wall cooperating to define an elongate cavity of substantially greater length than width and of substantial depth, and a single elongate resilient block of uniform depth that is snugly mounted in said cavity to completely fill the same and terminate in a flat striking surface that has a central portion situated between said recesses, said pairs of end walls and side walls have interior surfaces that taper rearwardly and inwardly towards one another and frictionally grip adjoining surfaces of said block, said striking surface capable of impacting a golf ball when said golf club putter is swung through a putting stroke, said striking surface upon said impact having the portion thereof between said pair of recesses momentarily deform to a generally elliptical rearwardly extending configuration that has the major axis thereof substantially normal to the surface on which said golf ball rests and said deformed striking surface portion while still in contact with said golf ball returning towards its initial configuration to impart a forward motion to said golf ball, with said pair of recesses serving the multiple functions of allowing said striking surface upon impact with said ball to deform to said rearwardly extending elliptical configuration that has the major axis normal to the surface on which said ball rests to impart a minimum lateral force to said ball that would cause it to deviate from a path normal to said striking face, and said pair of recesses exposing opposite side portions of said block that may be gripped between the thumb and forefinger of a user in inserting or removing said block from said cavity that said leading edges will not contact said golf ball, allowing said striking surface to deform upwardly and downwardly with greater ease than longitudinally for said deformed portion to assure said elliptical configuration, and exposing opposite side portions of said block that may be gripped between the thumb and forefinger of a user in inserting said block in said cavity or removing said block therefrom.

2. A golf club putter as defined in claim 1 in which a plurality of said resilient blocks are provided each of a different degree of resiliency to permit one of said blocks to be selected and inserted into said cavity with said selected block having a degree of resiliency that is most effective for a particular user.

* * * * *